US006682233B2

(12) United States Patent
Terao et al.

(10) Patent No.: US 6,682,233 B2
(45) Date of Patent: Jan. 27, 2004

(54) SUPPORTING STRUCTURE OF AN ARMATURE OF A WIRE DOT PRINTER HEAD

(75) Inventors: Yasunobu Terao, Tagata-gun (JP); Keishi Tsuchiya, Tagata-gun (JP); Takahiro Kawaguchi, Mishima (JP); Tetsuro Ichitani, Mishima (JP)

(73) Assignee: Toshiba TEC Kabushika Kaisha, Tokyo (JP)

( * ) Notice: Subject to any disclaimer, the term of this patent is extended or adjusted under 35 U.S.C. 154(b) by 0 days.

(21) Appl. No.: 10/098,555

(22) Filed: Mar. 18, 2002

(65) Prior Publication Data

US 2003/0175063 A1 Sep. 18, 2003

(51) Int. Cl.[7] ..... B41J 2/27; B41J 2/305; B41J 2/235; B41J 3/00

(52) U.S. Cl. ..... 400/124.24; 400/124.11; 400/124.14; 400/124.15; 400/154; 400/155; 400/155.1; 400/157.2; 101/93.04; 101/93.05

(58) Field of Search ..... 400/124.11, 124.14, 400/124.15–124.24, 154, 155, 155.1, 157.2, 124.01; 101/93.04, 93.05, 37, 109

(56) References Cited

U.S. PATENT DOCUMENTS

| | | | | | |
|---|---|---|---|---|---|
| 4,109,776 | A | * | 8/1978 | Ek et al. | 400/124.2 |
| 4,136,978 | A | * | 1/1979 | Bellinger, Jr. et al. | 400/124.21 |
| 4,433,926 | A | * | 2/1984 | Isobe et al. | 400/124.1 |
| 4,575,268 | A | * | 3/1986 | Yang et al. | 400/124.24 |
| 4,634,302 | A | * | 1/1987 | West et al. | 400/124.24 |
| 4,767,226 | A | * | 8/1988 | Sakaida et al. | 400/124.24 |
| 4,915,524 | A | * | 4/1990 | Mitsuishi et al. | 400/124.24 |
| 4,986,676 | A | * | 1/1991 | Kimura et al. | 400/124 |
| 5,056,942 | A | * | 10/1991 | Norigoe | 400/124.1 |
| 5,236,266 | A | * | 8/1993 | Mitsuishi et al. | 400/124.24 |
| 5,290,112 | A | * | 3/1994 | Stempfle et al. | 400/124.24 |
| 5,527,118 | A | * | 6/1996 | Asada et al. | 400/124.24 |

FOREIGN PATENT DOCUMENTS

| | | | | |
|---|---|---|---|---|
| EP | 0431876 A2 | * | 6/1991 | B41J/2/26 |
| JP | 5-238019 | | 9/1993 | |
| JP | 05238019 | * | 9/1993 | B41J/2/275 |
| JP | 2001-30523 | | 2/2001 | |

OTHER PUBLICATIONS

U.S. application Ser. No. 10/098,555, Terao et al., filed Mar. 18, 2002.

U.S. application Ser. No. 10/376,268, Terao, filed Mar. 3, 2003.

* cited by examiner

*Primary Examiner*—Charles H. Nolan, Jr.
*Assistant Examiner*—Wasseem H. Hamdan
(74) *Attorney, Agent, or Firm*—Oblon, Spivak, McClelland, Maier & Neustadt, P.C.

(57) ABSTRACT

In a wire dot printer head of the present invention, an armature is formed by coupling a magnetic circuit formation member having a supported piece with one end inserted into a cavity formed on a surface of a yoke to an arm coupled to a wire. The supported piece of the armature is rotatably supported by a support point, thereby a side surface of the cavity and a side surface of the supported piece, and a bottom surface of the cavity and an end surface of the supported piece can be set in the proximity. Accordingly, magnetic resistance between the magnetic circuit formation member and the yoke can be reduced.

4 Claims, 4 Drawing Sheets

SUPPORTING STRUCTURE OF AN ARMATURE OF A WIRE DOT PRINTER HEAD

BACKGROUND OF THE INVENTION

1. Field of the Invention

The present invention relates to a wire dot printer head of wire dot printer, and more particularly, to a structure where magnetic resistance between an armature and a yoke is reduced.

2. Discussion of the Background

Conventionally, known is a wire dot printer head, in which a coil is attached to a core magnetically coupled to a yoke and an armature to drive a wire is provided capable of approaching/separating to/from the core. Printing is performed by driving the armature by feeding a current through the coil and colliding the wire against a print sheet by driving energy of the armature.

The requirement for armature performance is to reduce weight for high speed operation while have a function of forming a magnetic circuit to the yoke and the core and a function of driving the wire. This requirement for the armature is met by constructing the armature by coupling a magnetic circuit formation member for forming a magnetic circuit with respect to the yoke and the core to a light-weight and high-strength arm, and by coupling the wire to an end of the wire.

As usage of the armature comprised of the magnetic circuit formation member and the arm, if the portion of the magnetic circuit formation member is simply provided to be opposed to end surfaces of the core and the yoke, it is structurally difficult to increase opposing surface areas of the magnetic circuit formation member and the yoke. As a result, magnetic resistance between the magnetic circuit formation member and the yoke increases, and the speed of response operation of the armature when a current is fed through the coil is lowered.

Japanese Laid-Open Publication No. Hei 5-238019 discloses an armature constructed by coupling a magnetic material for formation of a magnetic circuit with respect to the yoke and arm to a light-weight and high-strength arm. In this Japanese Laid-Open Publication No. Hei 5-238019, a projecting coupling member having a half-round cross section is formed in a magnetic path portion of the armature, the coupling member is engaged in a recess-shaped rotation support member formed in a part of the yoke, and the armature is rotated about the rotation support member.

However, as apparent from Japanese Laid-Open Publication No. Hei 5-238019, the projecting coupling member formed in the magnetic path portion of the armature and the recess-shaped rotation support member formed in the yoke have mutually opposing surfaces in contact with each other. There is no idea of feeding a magnetic flux between an inner surface of the recess-shaped rotation support member and an outer surface of the coupling member of the armature.

SUMMARY OF THE INVENTION

Accordingly, an object of the present invention is to realize a light-weight and high-strength arm to drive the wire, and especially to reduce the magnetic resistance between the magnetic circuit formation member, coupled to the arm to construct the armature, and the yoke.

The object of the present invention is attained by a novel wire dot printer head of the present invention.

Thus, according to the novel wire dot printer head of the present invention, as an armature is formed by coupling a magnetic circuit formation member having a supported piece with its one end inserted into a cavity formed on the surface of the yoke to an arm coupled to a wire, and the supported piece of the armature is rotatably supported by a support member, and a gap between a side surface of the cavity and a side surface of the supported piece, and a gap between a bottom surface of the cavity and an end surface of the supported piece can be maintained in status of constant proximity. Accordingly, the magnetic resistance between the magnetic circuit formation member and the yoke can be reduced.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENT

Figure 1:
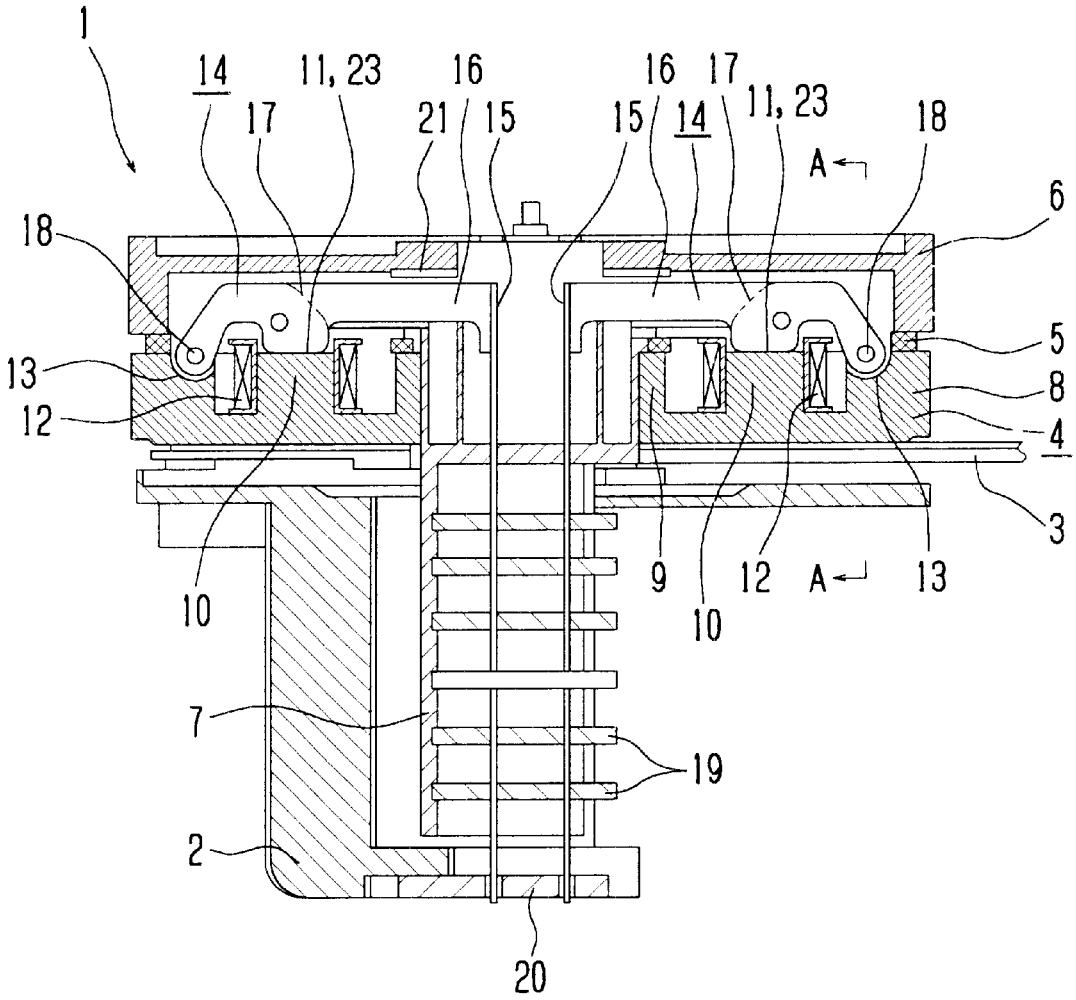
FIG. 1 is a central longitudinal cross-sectional front view of a wire dot printer head of the present invention.

Obviously, numerous modifications and variations of the present invention are possible in light of the above teachings. It is therefore to be understood that within the scope of the appended claims, the invention may be practiced otherwise than as specifically described herein.

An embodiment of the present invention will be described with reference to FIGS. 1 to 3.

First, the entire structure of a wire dot printer head 1 will be described with reference to FIG. 1. The wire dot printer head 1 is formed by sequentially depositing a front case 2, a circuit board 3, a yoke 4, an armature spacer 5 and a rear case 6. The front case 2 and the rear case 6 are connected to each other by attachment screws (not shown), and the circuit board 3, the yoke 4 and the armature spacer 5 are held between the front case 2 and the rear case 6. The yoke 4 is made of magnetic material. The yoke 4 has an outer peripheral part 8 and an inner cylindrical part 9, and plural cores 10 are integrally formed between the outer peripheral part 8 and the cylindrical part 9. These cores 10 have a magnetic pole surface 11 at an end in an axial direction. A coil 12 is attached around an outer periphery of the cores 10. Plural cavities 13 corresponding to the cores 10 are formed in the outer peripheral part 8 of the yoke 4. An armature 14 opposed to the core 10 is comprised of an arm 16 to which a wire 15 is wax-bonded and a magnetic circuit formation member 17 welded to both side surfaces of the arm. These armatures 14 are rotatably supported by a support shaft 18 as a support point. The direction of the support shaft 18 is orthogonal to an axis of the core 10. A wire guide 7 is provided with plural guide chips 19 to slidably guide the wire 15, and an end guide 20 which arrays the ends of the wires to slidably guide the arrayed wires 15 is provided at an end of the front case 2.

The armature 14 rotates about the support shaft 18 in a printing direction when a current is fed through the coil 12. The armature 14 is biased in a returning direction by a biasing member (not shown) such that it is returnable in the returning direction about the support shaft 18 when the current fed through the coil 12 is cut. A ring shaped armature stopper 21 is provided at the center of the rear case 3. The armature stopper 21 has a function to be contact with the arm 16 of the returning armature 14 to define a return position of the armature 14.

Figure 3:
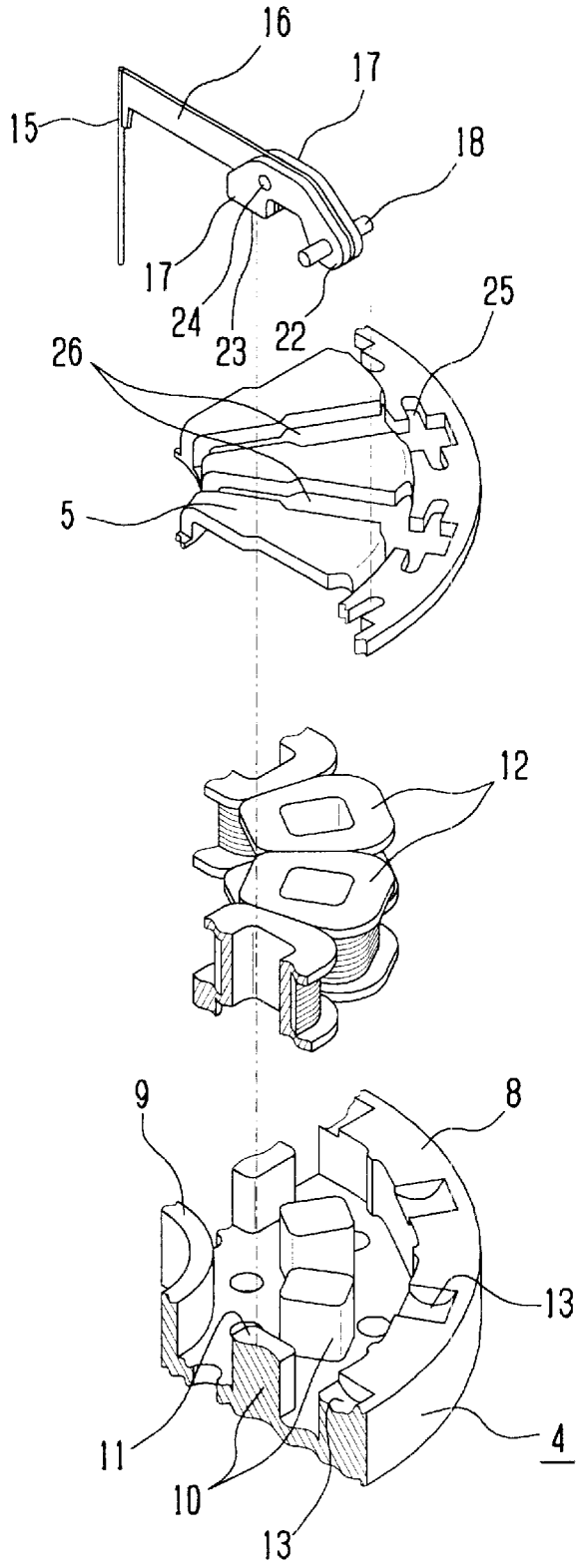
FIG. 3 is an exploded partially cut-away perspective view of a yoke and an armature spacer for explanation of the armature support structure.

Referring to FIG. 3, the particular shapes of the yoke 4, the armature spacer 5 and the armature 14 will be described. The respective cores 10 are formed in the yoke 4 radially with respect to the center of the yoke 4. The cavity 13 is provided on a phantom straight line connecting the center of the yoke 4 and the center of the magnetic pole surface 11 of the core 10. The magnetic circuit formation member 17 of the armature 14 is made of magnetic material. The magnetic circuit formation member 17 has a supported piece 22 inserted into the cavity 13 formed in the yoke 4 and an attracted surface 23 attracted by the magnetic pole surface 11 of the core 10. The support shaft 18 is removably engaged in a round through hole (not shown) formed in the supported piece 22 and the arm 16. A through hole 24 is formed in parallel to the support shaft 18 in the arm 16 and the magnetic circuit formation member 17 provided on both side surfaces of the arm. The arm 16 and the magnetic circuit formation member 17 are coupled by inserting the support shaft 18 through a through hole (not shown), inserting a shaft (not shown) through the through hole 24 in parallel to the support shaft 18, and in that status, welding the magnetic circuit formation member 17 provided on both side surfaces of the arm 16. After the welding, the shaft is pulled out of the through hole 24.

In the present embodiment, the support shaft 18 is in contact with the outer peripheral part 8 of the yoke 4 with its both end portions are on both sides of the cavity 13. The armature spacer 5 is provided between the yoke 4 and the rear case 6 for formation of space to enable rising and falling operation of the armature 14. Plural grooves 25 in which the respective support shafts 18 are engaged are formed in the armature spacer 5. These grooves 25 define positions of the respective support shafts 18 which are in contact on the yoke 4 in an axial direction and positions in a direction orthogonal to the axial direction. Plural guide grooves 26 in which the respective armatures 14 are inserted are formed in the armature spacer 5.

Figure 2:
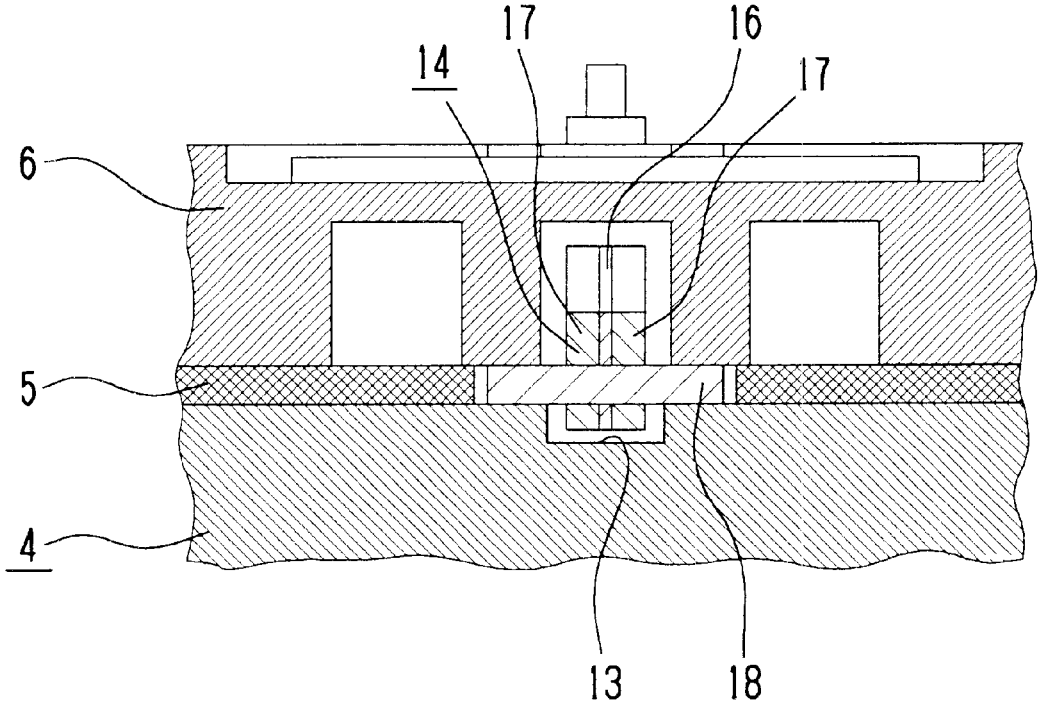
FIG. 2 is a partial longitudinal cross-sectional side view along a line A—A in FIG. 1 for explanation of armature support structure.

As apparent from FIGS. 1 and 3, a bottom surface of the cavity 13 and an end surface of the supported piece 22 opposed to the bottom surface with a slight gap therebetween are formed to have an arc shape along a radius of the support shaft 18.

In the present embodiment, the armature spacer 5 is formed by forging or the like using a silicon steel plate as a squeeze-processable low-price magnetic material for enabling flow of magnetic flux between the both side surfaces of the magnetic circuit formation member 17 of the armature 14 and the spacer. The yoke 4, the core 10 and the magnetic circuit formation member 17 of the armature 14 are formed by metal injection or the like using Permendur as a ferromagnetic material. The arm 16 of the armature 14 is formed by pressing using high-strength marageing steel or light-weight titanium alloy for wax-bonding to the wire 15. The support shaft 18 is made of e.g. SUS for improvement in abrasion resistance and holding a round shape.

As the structure of wire dot printer using the wire dot printer head 1 is already known, the basic structure will be briefly described without drawing. The wire dot printer has the wire dot printer head 1, a carriage holding the wire dot printer head 1, scanned in a straight liner direction, a platen arranged along the scanning direction of the carriage, and a conveyance roller which conveys a print sheet to a position between the platen and the wire dot printer head 1.

The operation of the wire dot printer will be described. The wire dot printer head 1 is scanned by the carriage along the platen. The coil 12 selected in correspondence with print data is energized by current upon carriage scanning. As the current is fed through the coil 12, a magnetic flux flows through the core 10, the magnetic circuit formation member 17 of the armature 14, the yoke 4 and the core 10 in this order. Accordingly, the armature 14 corresponding to the coil 12 rotates about the support shaft 18 toward a direction in which the attracted surface 23 of the magnetic circuit formation member 17 is attracted by the magnetic pole surface 11 of the core 10. The wire 15 is driven in the printing direction by rotation operation of the armature 14. FIG. 1 shows a moment at which the end of the wires 15 are driven to the print sheet side. The energization to the coil 12 is made instantaneously. When the current fed through the coil 12 is cut, the armature 14 rotates in the returning direction about the support shaft 18. The energy to cause the armature 14 to return in the returning direction is caused by, as described above, the biasing force of the biasing member to bias the armature 14 in the returning direction and repulsion applied to the wire 15 from the platen by impact between the platen and the wire 15.

As the supported piece 22 of the magnetic circuit formation member 17 constructing the armature 14 is inserted into the cavity 13 formed in the yoke 4, an outer side surface of the supported piece 22 opposite to the arm 16 and the inner side surface of the cavity 13 are set in the proximity and a magnetic flux can be fed therebetween. As the magnetic flux is fed between the outer side surface of the supported piece 22 and the inner side surface of the cavity 13, the magnetic resistance between the yoke 4 and the magnetic circuit formation member 17 of the armature 14 can be reduced.

As the armature spacer 5 allows flow of magnetic flux between the spacer and the both sides of the magnetic circuit formation member 17 of the armature 14, the magnetic resistance between the yoke 4 and the magnetic circuit formation member 17 of the armature 14 can be reduced.

As the bottom surface of the cavity 13 is formed in arc shape along the radius of the support shaft 18, a gap between the bottom surface of the armature 14 and one end of the supported piece 22 is kept constant regardless of positional change of the armature 14 in the rotation direction. As the one end of the supported piece 22 is formed into arc shape along the radius of the support shaft 18, a gap between the end of the supported piece 22 and the bottom surface of the cavity 13 is uniformly kept in the entire area of the end of the supported piece 22.

As the arm 16 is provided on a phantom straight line connecting the center of the yoke 4 and the center of the magnetic pole surface 11 of the core 10, and the arm 16 is held by the plural magnetic circuit formation members 17 symmetrically provided on the both side surfaces of the arm, the balance of the armature 14 can be easily achieved.

As the material of the arm 16, any of magnetic material, weak magnetic material and non-magnetic material may be used. If the arm 16 is made of weak magnetic material or non-magnetic material, as a magnetic flux does not flow through the arm 16 easily, magnetic efficiency is lowered. Further, if a high-strength and lightweight material such as titanium alloy is selected as the material of the arm 16, the arm 16 and the wire 15 can be firmly wax-bonded to each other, and inertial moment of the armature 14 can be reduced.

Figure 4:
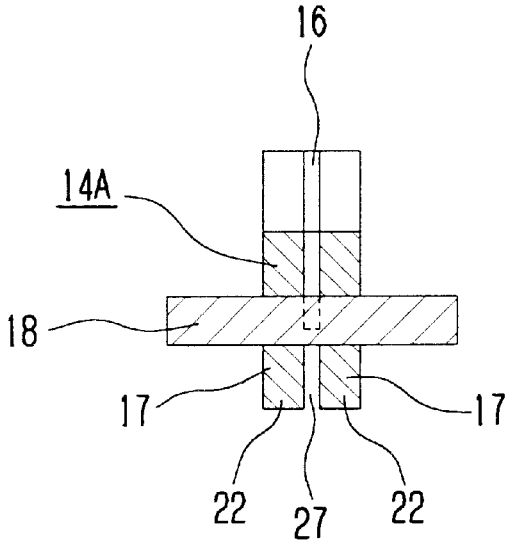
FIG. 4 is a longitudinal cross-sectional side view of another armature.
Figure 5:
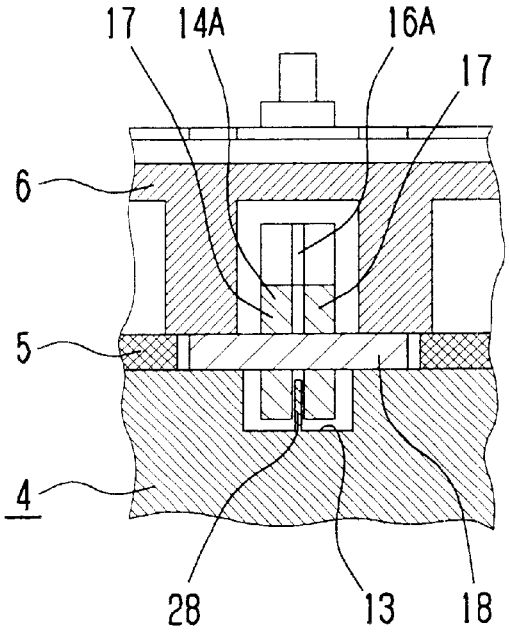
FIG. 5 is a partial longitudinal cross-sectional side view along the line A—A in FIG. 1 for explanation of another armature support structure.

Another embodiment of the present invention will be described with reference to FIGS. 4 and 5. The cross-sectional positions of FIGS. 4 and 5 are along the A—A line in FIG. 1.

As an armature 14A in the present embodiment is basically the same as the armature 14 described in the above-described embodiment, only the difference will be described. An arm 16A in the present embodiment has a length not to allow one end of the support shaft 18 to reach the end of the supported piece 22. More particularly, the arm 16A is short such that a half-round notch is formed for passing the support shaft 18. As shown in FIG. 4, a gap 27 corresponding to a plate thickness of the arm 16A is formed between the supported pieces 22 of the magnetic circuit formation member 17. As shown in FIG. 5, a projection piece 28 projecting in the gap 27 between the supported pieces 22 is integrally formed at the center of the cavity 13 of the yoke 4.

Accordingly, as in the case of the above-described embodiment, an outer side surface of the supported piece 22 opposite to the arm 16A and the inner side surface of the cavity 13 are set in the proximity and a magnetic flux can be fed therebetween, and an inner side surface of the supported piece 22 and an outer side surface of the projection piece 28 are set in the proximity and a magnetic flux can also be fed therebetween. In this manner, as the projection piece 28 projecting in the gap 27 between the supported pieces 22 is formed at the center of the cavity 13 of the yoke 4, opposing surface areas of the supported piece 22 and the yoke 4 can be increased, and the magnetic resistance between the yoke 4 and the magnetic circuit formation member 17 of the armature 14 can be effectively reduced.

In this manner, the spillover effect from the construction where the projection piece 28 projecting in the gap 27 between the supported pieces 22 is that, since the length of the arm 16A on the side of the end of the supported piece 22 is shortened, contact area of the arm 16A and the support shaft 18 is reduced, and abrasion of the arm 16A due to contact between the arm 16A and the support shaft 18 can be suppressed.

Also in the present embodiment, as the bottom surface of the cavity 13 has an arc shape along a radius of the support shaft 18, a gap between the bottom surface of the armature 14 and the one end of the supported piece 22 is kept constant regardless of positional change of the armature 14 in the rotation direction. As the one end of the supported piece 22 is formed into arc shape along the radius of the support shaft 18, the gap between the end of the supported piece 22 and the bottom surface of the cavity 13 is uniformly kept in the entire area of the end of the supported piece 22.

What is claimed is:

1. A supporting structure of an armature of a wire dot printer head, comprising:

a yoke made of magnetic material;

a core made of magnetic material, with a magnetic pole surface at one end and magnetically coupled to the yoke;

a coil attached to the core;

a cavity formed in a position in proximity to the core on a surface of the yoke;

an armature formed by coupling a magnetic circuit formation member made of magnetic material having a supported piece with one end inserted into the cavity and an attracted surface attracted to the magnetic pole surface of the core, to an arm coupled to a rear end of a wire to strike a print sheet at an end;

a support point that rotatably supports the supported piece, an axis of the supported piece is orthogonal to an axis of the core; and an armature spacer made of magnetic material that allows a flow of magnetic flux between both sides of the magnetic circuit formation member, wherein a part of the armature spacer is provided in contact with the yoke, wherein the support point includes a support shaft of magnetic material in contact with the yoke, and wherein a groove that defines a position of the support shaft is formed in the armature spacer.

2. The supporting structure according to claim 1, wherein the support point is provided outside of the cavity.

3. A supporting structure of an armature of a wire dot printer head, comprising:

a yoke made of magnetic material;

a core made of magnetic material, with a magnetic pole surface at one end and magnetically coupled to the yoke;

a coil attached to the core;

a cavity formed in a position in proximity to the core on a surface of the yoke;

an armature formed by coupling a pair of magnetic circuit formation members made of magnetic material each having a supported piece with one end inserted into the cavity and an attracted surface attracted to the magnetic pole surface of the core, to an arm coupled to a rear end of a wire to strike a print sheet at an end;

a support point that rotatable supports each of the supported pieces, an axis of each of the supported pieces being orthogonal to an axis of the core;

wherein the supported pieces of the pair of magnetic circuit formation members are provided on both sides of the arm, and wherein a projection piece made of magnetic material that projects between the supported pieces of the magnetic circuit formation members provided on both sides of the arm is formed at a center of the cavity.

4. The supporting structure according to claim 3, wherein the support point is provided outside of the cavity.

* * * * *

UNITED STATES PATENT AND TRADEMARK OFFICE

CERTIFICATE OF CORRECTION

PATENT NO. : 6,682,233 B2
DATED : January 27, 2004
INVENTOR(S) : Terao et al.

It is certified that error appears in the above-identified patent and that said Letters Patent is hereby corrected as shown below:

Title page,
Item [73], Assignee, should read:
-- [73] Assignee: Toshiba TEC Kabushiki Kaisha,
Tokyo (JP) --

Signed and Sealed this

Thirteenth Day of April, 2004

JON W. DUDAS
*Acting Director of the United States Patent and Trademark Office*